US006664894B2

(12) United States Patent
Pakhomov

(10) Patent No.: US 6,664,894 B2
(45) Date of Patent: Dec. 16, 2003

(54) PERIMETER SYSTEM FOR DETECTING INTRUDERS

(75) Inventor: Alex Pakhomov, Ardsley, NY (US)

(73) Assignee: General Phosphorix LLC, Ardsley, NY (US)

( * ) Notice: Subject to any disclaimer, the term of this patent is extended or adjusted under 35 U.S.C. 154(b) by 61 days.

(21) Appl. No.: 09/788,238

(22) Filed: Feb. 16, 2001

(65) Prior Publication Data

US 2002/0113700 A1 Aug. 22, 2002

(51) Int. Cl.[7] ..... G08B 13/00
(52) U.S. Cl. ..... 340/541; 340/506; 340/531
(58) Field of Search ..... 340/505, 506, 340/517, 531, 552, 553, 540, 541, 547, 566, 544, 522, 545.2

(56) References Cited

U.S. PATENT DOCUMENTS

| | | | | |
|---|---|---|---|---|
| 4,562,428 A | * | 12/1985 | Harman et al. | 340/552 |
| 4,780,872 A | * | 10/1988 | Masuda et al. | 340/825.52 |
| 4,929,927 A | * | 5/1990 | Uhlin | 340/547 |
| 5,726,627 A | * | 3/1998 | Kane et al. | 340/531 |
| 6,204,760 B1 | * | 3/2001 | Brunius | 340/539 |
| 6,278,365 B1 | * | 8/2001 | Kane et al. | 340/531 |

* cited by examiner

*Primary Examiner*—Van Trieu
(74) *Attorney, Agent, or Firm*—I. Zborovsky

(57) ABSTRACT

A system for detecting an intruder has a plurality of group of sensors connected in parallel with one another, a plurality of individual processing units each connected with at least one of the groups of sensors, the individual processing units, a central processing unit connected with all the parallel-connected individual processing units and receiving signal from the latter.

9 Claims, 2 Drawing Sheets

PERIMETER SYSTEM FOR DETECTING INTRUDERS

BACKGROUND OF THE INVENTION

The present invention relates to a system for detecting intruders.

More particularly, it relates to a system for detecting intruders, which has to provide a detection for intruders over a large areas and/or long distances.

Systems are known in with a plurality of sensors which detect the presence of an intruder. An additional processing equipment is connected with sensors and is complicated and expensive. When it is necessary to detect the intruders over long distances or over large areas, the equipment becomes even more complicated. It is believed to be advisable to provide a system which is less complicated, includes less components, and therefore is less expensive and also more reliable.

SUMMARY OF THE INVENTION

Accordingly, it is an object of present invention to provide a system for detecting of intruders which is a further improvement of the existing systems.

In keeping with these objects and with others which will become apparent hereinafter, one feature of present invention resides, briefly stated, in a system for detecting of intruders which includes a plurality of groups of sensors, each group including a plurality of individual sensors; a plurality of processing units each connected with at least one said groups of said sensors; and a central processing unit to which said individual processing units are connected by parallel connection, so that a central processing unit receives information about an intruder in an area of any of said sensors and of any of said groups of said sensors through a corresponding one of said individual processing units.

When the system is designed in accordance with the present invention, it is substantially simplified, it contains less components, and is less expensive, and also can cover larger areas or greater distances.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
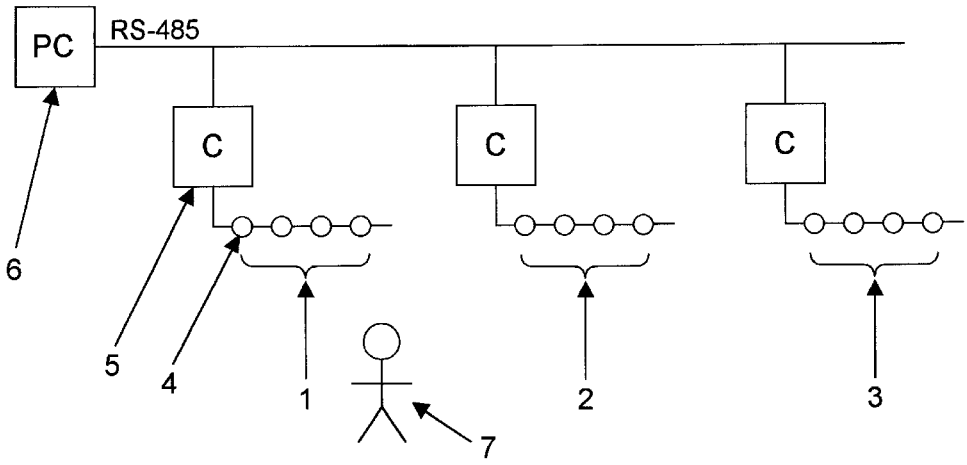
FIG. 1 is a view showing a system for detecting intruders in accordance with one embodiment of present invention.

A system for detecting intruders in accordance with one embodiment of the present invention is shown in FIG. 1. It includes a plurality of groups of sensors which are identified with reference numerals 1, 2, 3, etc. Each group of sensors includes a plurality of individual sensors identified with reference numeral 4. The sensors 4 in each group are connected parallel with one another. Moreover, all sensors of each group are connected to a single processing unit 5.

In accordance with the present invention, all individual processing units are connected with a central processing unit which is identified with reference numeral 6. The individual processing units 5 are connected parallel with one another and to the central processing unit 6.

The system operates in the following manner. When an intruder 7 approaches for example any sensor of the group 1, the sensor which can be formed as an acoustic sensor, a seismic sensor, or a combined acoustic-seismic sensor produces a signal which can be a voltage and supplies it to the corresponding processing unit 5. In the processing unit the processing of the signal is performed, for example as disclosed in our copending application serial number. After the processing, the signal which identifies the presence of the intruder is supplied to the central processing unit 6. Every individual processing unit 5 has its own coded identification number which is also supplied to the central processing unit together with the signal of the presence of the intruder.

The central processing unit 6 therefore receives the signal of the intruder in the area of the corresponding group of sensors. The signal in the central processing unit can be printed out, can be presented as a table, or can be presented on a map which will identify an area where the intruder was detected. The central processing unit 6 can also form a protocol of the events related to the intruding over a certain period of time. It can activate or deactive of a corresponding one of the processing unit so as to activate or deactive corresponding groups of sensors in corresponding areas. It can also indicate corresponding parameters of the processing in a corresponding one of the processing units 5. The central processing 6 can also change parameters of the processing in a corresponding one of the processing units 5.

In the inventive system therefore it is not necessary to provide individual interfaces for each individual processing unit 5. It suffices to have one interface line between all processing units 5 and the central processing unit 6, which substantially simplifies the system, provides a possibility of increasing the area of detection of intruders, reduces the cost of the overall system.

In contrast to the prior art systems in which every sensor has its own processing unit connected with the central processing unit, the number of wires in the inventive system are dramatically reduced, and the number of information channels are decreased as well. Since a part of the processing procedure is concentrated in a central processing unit 6, it is no longer necessary to perform the whole procedure either in the processing units 5, or the central processing unit 6. Therefore, the central processing unit 6 can be simplified, it can have a lower energy consumption, and can be less expensive as well.

Figure 2:
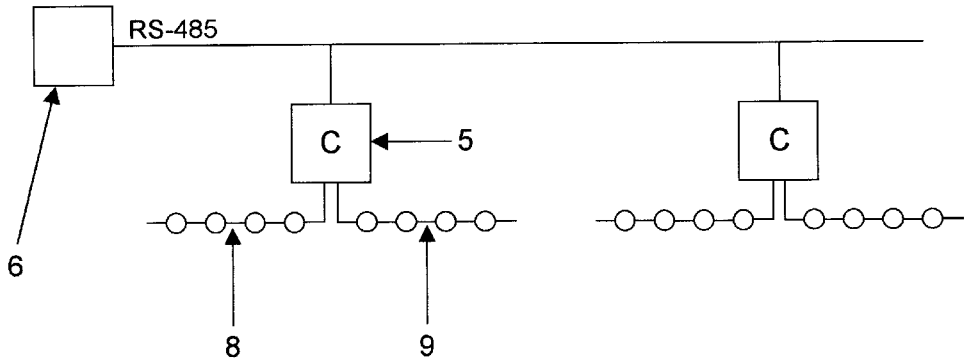
FIG. 2 is a view showing a system for detecting intruders in accordance with the another embodiment of the present invention.

FIG. 2 shows another embodiment of the present invention. In FIG. 2 each processing unit 5 is connected with two groups of sensors, such as groups 8 and 9. The processing unit 5 can have two processing channels so that the signals from the sensor group 8 and sensor group 9 are processed separately from one another and thereafter, the results of the processing are again submitted through the signal interface to the central processing unit 6. It further economizes on the connections and transmission channels, and also simplifies the transmission channels and simplifies in the construction.

Figure 3:
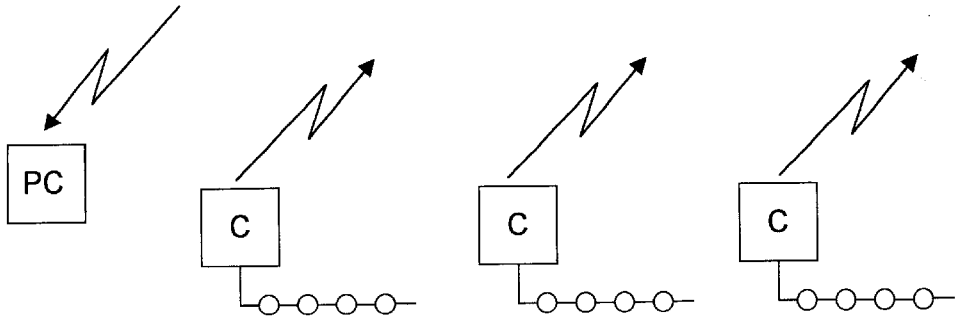
FIGS. 3 and 4 are views showing further embodiments of the present invention.

FIG. 3 shows still another embodiment of the present invention. Here the processing units are not connected with one another. Instead they are capable of transmitting information to the central processing unit in a wireless fashion, for example with the use of radio channels, or in other words via radio transmission.

Figure 4:
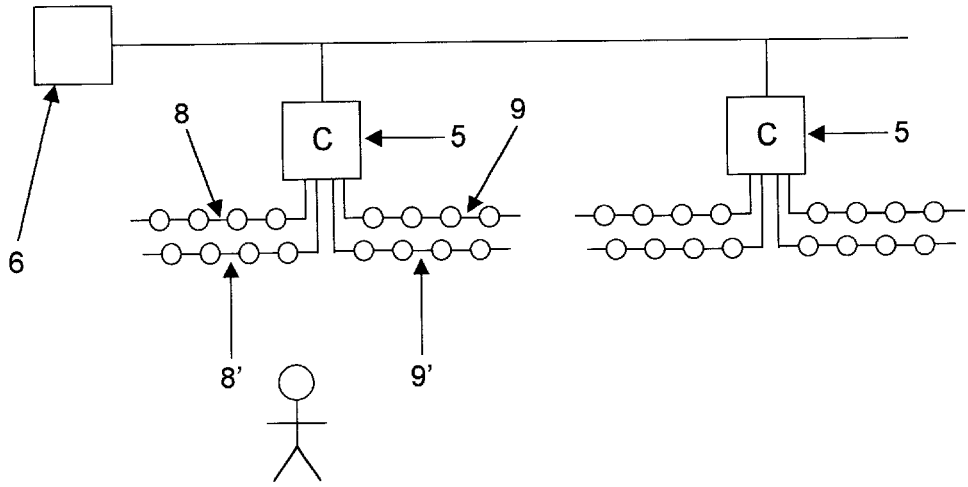

FIG. 4 shows a further embodiment of the present invention. Here the groups of sensors 8 and 8' extend substantially parallel to one another and are spaced from one another. They are both connected with the single processing unit 5 which can have different channels for processing of the signals from the sensor groups 8 and 8'. The processing unit 5 recognizes from which sensor group 8 or 8' the signal is earlier received. As a result, it is possible to determine whether an intruder crosses the zone provided with the sensors from the side of the sensor group 8 or from the side of the sensor groups 8'. This is very important for detecting intruders which cross boarders from one country into another. The sensor groups 8 and 8' can be laid along the country boarders for this purpose.

It should be mentioned that the processing units are operable for receiving a signal from each individual processing unit for detecting the presence of an intruder.

It will be understood that each of the elements described above, or two or more together, may also find a useful application in other types of constructions differing from the types described above.

While the invention has been illustrated and described as embodied in system for detecting intruders, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A system for detecting of an intruder, comprising a plurality groups of sensors connected in parallel with one another, said sensors being selected from the group consisting of seismic sensors, acoustic sensors and both; a plurality of individual processing units each connected with a respective one of said groups of sensors; said individual processing units are connected in parallel with one another; a central processing unit connected with all said parallel-connected processing units so that each of said individual processing units can obtain information about a presence of an intruder near any of said group of sensors.

2. A system as defined in claim 1, wherein at least one of said individual processing units is connected with one of said groups of sensors.

3. A system as defined in claim 1, wherein at least one of said individual processing units is connected with at least two groups of sensors.

4. A system as defined in claim 1, wherein said central processing unit receives signals from said individual processing units about a presence of intruder, and also sends additional signals to said individual processing units.

5. A system as defined in claim 4 wherein central signal processing unit is operative for controlling said individual processing units.

6. A system as defined in claim 1, wherein said at least two of said groups of sensors extend substantially in a same direction, are spaced from one another, and connected to a single respective one of said individual processing units, so that signals produced by said two groups of sensors and received by said respective one of said individual processing units are indicative of a direction from which an intruder crosses an area covered by said two groups of sensor.

7. A system for detecting of an intruder, comprising a plurality groups of sensors connected in parallel with one another, said sensors being sensors selected from the group consisting of seismic sensors, acoustic sensors and both; a plurality of individual processing units each connected with a respective one of aid groups of sensors; said individual processing units are connected in parallel with one another; a central processing unit connected with all said parallel-connected processing units by a single line so that each of said individual processing units can obtain information about a presence of an intruder ear any of said group of sensors.

8. A system for detecting of an intruder, comprising a plurality groups of sensors connected in parallel with one another, said sensors being sensors selected from the group consisting of seismic sensors, acoustic sensors and both; a plurality of individual processing units each connected with a respective one of said groups of sensors, each of said groups of sensors being connected with a respective one of said individual processing units by a single line; said individual processing units are connected in parallel with one another; central processing unit connected with all said parallel-connected processing units by a single line so that each of said individual processing units can obtain information about a presence of an intruder near any of said group of sensors.

9. A system for detecting of an intruder, comprising a plurality groups of sensors connected in parallel with one another, said sensors being sensors selected from the group consisting of seismic sensors, acoustic sensors and both; a plurality of individual processing units each connected with a respective one of aid groups of sensors; said individual processing units are connected in parallel with one another; a central processing unit connected with all said parallel-connected processing units by a single line so that each of said individual processing units can obtain information about a presence of an intruder near any of said group of sensors, each of said groups of sensors being connected with a respective one of said individual processing units by a single line.

* * * * *